US010661323B2

(12) United States Patent
Okada et al.

(10) Patent No.: US 10,661,323 B2
(45) Date of Patent: May 26, 2020

(54) APPARATUS FOR AND METHOD OF MANUFACTURING ROLL-FORMED COMPONENT HAVING VARIABLE WIDTH

(71) Applicant: KAWASAKI JUKOGYO KABUSHIKI KAISHA, Kobe-shi, Hyogo (JP)

(72) Inventors: Hideki Okada, Kakamigahara (JP); Yasuhiro Kasumi, Seki (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 399 days.

(21) Appl. No.: 15/391,441

(22) Filed: Dec. 27, 2016

(65) Prior Publication Data

US 2017/0203350 A1 Jul. 20, 2017

(30) Foreign Application Priority Data

Dec. 28, 2015 (JP) ..... 2015-256347

(51) Int. Cl.
*B21D 5/08* (2006.01)
*B21D 5/14* (2006.01)
*B21D 5/06* (2006.01)

(52) U.S. Cl.
CPC ..... *B21D 5/14* (2013.01); *B21D 5/08* (2013.01); *B21D 5/083* (2013.01); *B21D 5/06* (2013.01)

(58) Field of Classification Search
CPC . B21D 5/06; B21D 5/08; B21D 5/083; B21D 5/086; B21D 5/12; B21D 5/14
See application file for complete search history.

(56) References Cited

U.S. PATENT DOCUMENTS

| | | | | |
|---|---|---|---|---|
| 3,268,985 A | 8/1966 | Smith | | |
| 4,080,815 A | 3/1978 | Foster | | |
| 5,722,278 A * | 3/1998 | Horino | B21D 5/083 | 72/11.1 |
| 2004/0112103 A1* | 6/2004 | Gorski | B21D 5/08 | 72/181 |

FOREIGN PATENT DOCUMENTS

| | | | | |
|---|---|---|---|---|
| DE | 102004040257 A1 * | 12/2005 | B21D 5/083 | |
| JP | 58103917 A * | 6/1983 | B21D 5/086 | |
| JP | H07-305151 A | 11/1995 | | |
| JP | H09-29347 A | 2/1997 | | |
| JP | H09-239452 A | 9/1997 | | |
| JP | 2002-35848 A | 2/2002 | | |
| JP | 2003-305517 A | 10/2003 | | |

OTHER PUBLICATIONS

EPO machine translation of DE-102004040257-A1 (Year: 2019).*

* cited by examiner

*Primary Examiner* — Pradeep C Battula
(74) *Attorney, Agent, or Firm* — Oliff PLC

(57) ABSTRACT

Forming roll units included in an apparatus for manufacturing a roll-formed component each include a roll pair. The roll pair includes a receiving roll part and a first bending roll part that face each other. A plate member passing area is formed below the first bending roll part, the plate member passing area allowing a roll formed member excluding its side edge portions to pass through. The roll pair is configured to make, during bending, sliding movement in a width direction of the roll formed member and rotational movement about a normal direction to the roll formed member as a rotational center.

11 Claims, 8 Drawing Sheets

APPARATUS FOR AND METHOD OF MANUFACTURING ROLL-FORMED COMPONENT HAVING VARIABLE WIDTH

BACKGROUND OF THE INVENTION

1. Field of the Invention

The present invention relates to an apparatus for and a method of manufacturing a roll-formed component having a varying dimension (height) in its width direction, the dimension varying continuously in the longitudinal direction of the roll-formed component.

2. Description of the Related Art

Examples of structural members used for manufacturing an aircraft include stringers, stiffeners, spars, floor beams, ribs, frames, doublers, etc. One example of a method of manufacturing such a structural member is roll forming. In the roll forming, a flat plate-shaped metal member is formed into a predetermined cross-sectional shape by a plurality of roll members. Such a structural member formed into a predetermined cross-sectional shape is often imparted with a contour (a curved shape). By performing roll bending of the structural member after the roll forming thereof, the structural member having a predetermined cross-sectional shape and imparted with a contour can be manufactured. It should be noted that, in the description below, the term "roll forming" also covers roll bending.

One example of a method of manufacturing a structural member by using roll forming is roll assembly disclosed by U.S. Pat. No. 4,080,815. This patent literature discloses that, in the roll assembly, a contour can be imparted to a structural member whose cross-sectional shape is, for example, a T shape, L shape, Z shape, or a hat shape.

SUMMARY OF THE INVENTION

In the fields of automobiles and building materials, there is a known technique of imparting a variable width to a linear roll-formed component. The term "variable width" herein refers to a state where the dimension of a roll-formed component in its width direction (i.e., the height of the roll-formed component in its width direction) is not constant, but varies continuously in the longitudinal direction of the roll-formed component.

However, there has been no known technique of imparting both a variable width and a contour to a structural member for aircraft use during manufacturing of the structural member by roll forming. Specifically, among structural members for aircraft use, some of them have such a cross-sectional shape that a side edge portion or side edge portions of a structural member in its width direction is/are bent, for example, L-shaped or Z-shaped. It has been substantially difficult to impart, by roll bending, both a contour and a variable width to a structural member having such a complex cross-sectional shape.

The present invention has been made to solve the above-described problems. It is an object of the present invention to provide an apparatus for and a method of manufacturing a roll-formed component having a cross section in which at least one of side edge portions of the roll-formed component in its width direction is bent, the apparatus and the method being capable of imparting a contour to the roll-formed component after imparting a variable width thereto.

In order to solve the above-described problems, an apparatus for manufacturing a roll-formed component for aircraft use according to the present disclosure includes: a plurality of forming roll units arranged along a bending path, on which a roll formed member (elongated plate member) is subjected to bending in a longitudinal direction of the roll formed member, the forming roll units performing the bending of the roll formed member while applying external forces to the roll formed member in a width direction of the roll formed member. Each of the forming roll units includes at least one roll pair, the roll pair including a receiving roll part and a bending roll part facing the receiving roll part, the receiving roll part coming into contact with at least one of side edge portions of the roll formed member. A plate member passing area is formed below or above the bending roll part, the plate member passing area allowing the roll formed member excluding the side edge portions to pass through. The at least one roll pair is configured to make, during the bending, sliding movement in the width direction of the roll formed member and rotational movement about a normal direction to the roll formed member as a rotational center.

According to the above-described configuration, in each of the plurality of forming roll units arranged along the bending path, during the bending, the roll pair including the receiving roll part and the bending roll part can make sliding movement in the width direction of the roll formed member and rotational movement about the normal direction to the roll formed member as a rotational center. Accordingly, the roll pair can slidingly move, and also rotate to become perpendicular to the roll formed member. In addition, in the case of manufacturing a roll-formed component having a variable dimension in its width direction, the roll pair can be caused to make sliding movement such that the amount of the sliding is changed in accordance with the width of the roll formed member passing through the roll pair, and also, the roll pair can be caused to make smooth rotational movement while keeping the normal direction to the roll formed member as much as possible.

According to the above configuration, the forming roll units impart a variable width (i.e., such a machining shape that the dimension in the width direction varies in the longitudinal direction). In addition, the plurality of forming roll units impart a contour (a curved shape) to the conveyed roll formed member. Consequently, a formed component to which a contour and a variable width have been imparted can be readily manufactured without performing, for example, stretch forming or press forming.

The apparatus for manufacturing a roll-formed component with the above-described configuration may be configured to convey the roll formed member by sandwiching the at least one of the side edge portions between the receiving roll part and the bending roll part included in the roll pair.

In the apparatus for manufacturing a roll-formed component with the above-described configuration, the at least one roll pair included in each of the forming roll units may include a first roll pair and a second roll pair positioned below or above the first roll pair. The first roll pair may come into contact with and machine one side edge portion of the roll formed member. The second roll pair may come into contact with and machine another side edge portion of the roll formed member.

In the apparatus for manufacturing a roll-formed component with the above-described configuration, the bending roll part may be configured such that, during the bending, a distance between the bending roll part and the receiving roll part is changeable in accordance with a thickness of the passing roll formed member.

In the apparatus for manufacturing a roll-formed component with the above-described configuration, each of the forming roll units may be configured such that the first roll pair makes sliding movement relative to the second roll pair in accordance with a change in the width of the passing roll formed member.

In the apparatus for manufacturing a roll-formed component with the above-described configuration, the receiving roll part may include a first roll. The bending roll part may include a second roll alone or second and third rolls. The second and third rolls may be positioned parallel to each other, and a distance between the second and third rolls may be changed during the bending.

In the apparatus for manufacturing a roll-formed component with the above-described configuration, each of the forming roll units may further include a sixth roll positioned above or below the bending roll part, and the sixth roll may have a rotational axis crossing rotational axes of the receiving roll part and the bending roll part, and bend one of the side edge portions toward the second roll.

In the apparatus for manufacturing a roll-formed component with the above-described configuration, the sixth roll may be configured such that, during the bending, a distance between the third roll and the sixth roll is changeable and the sixth roll is movable in the width direction of the roll formed member.

In the apparatus for manufacturing a roll-formed component with the above-described configuration, the plurality of forming roll units arranged along the bending path may be at least three forming roll units, and directions of the external forces applied to the roll formed member in the width direction by the forming roll units immediately adjoining each other may be set to be opposite to each other.

In the apparatus for manufacturing a roll-formed component with the above-described configuration, the plurality of forming roll units arranged along the bending path may be at least four forming roll units. Directions of the external forces applied to the roll formed member in the width direction by the forming roll units positioned at both ends of the bending path may be set to be the same. Directions of the external forces applied to the roll formed member in the width direction by the forming roll units interposed between the forming roll units positioned at both ends of the bending path may be set to be opposite to the directions of the external forces applied by the forming roll units positioned at both ends of the bending path.

In the apparatus for manufacturing a roll-formed component with the above-described configuration, the roll-formed component may be for aircraft use.

The present disclosure also encompasses a method of manufacturing a roll-formed component, the method including: manufacturing a roll-formed component by using the above-described apparatus for manufacturing a roll-formed component. The manufactured roll-formed component has: a cross section in which a side edge portion of the roll-formed component in its width direction is bent; a varying dimension in the width direction of the roll-formed component, the dimension varying continuously in a longitudinal direction of the roll-formed component; and a curved shape imparted in the longitudinal direction.

The present invention with the above-described configuration has an advantage of being able to provide an apparatus for and a method of manufacturing a roll-formed component having a cross section in which at least one of side edge portions of the roll-formed component in its width direction is bent, the apparatus and the method being capable of imparting a contour to the roll-formed component after imparting a variable width thereto.

The above and other objects, features, and advantages of the present invention will more fully be apparent from the following detailed description of preferred embodiments with accompanying drawings.

DESCRIPTION OF THE PREFERRED EMBODIMENTS

Figure 1:
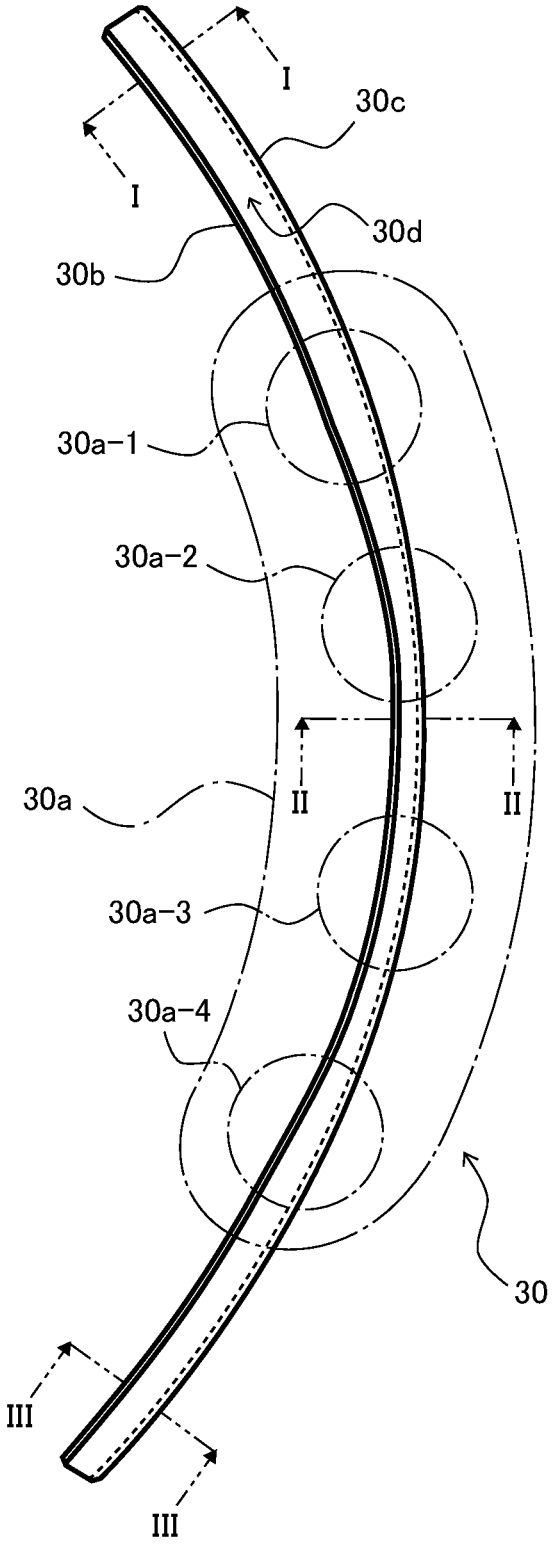
FIG. 1 is a plan view showing a schematic configuration of a frame having a variable width, the frame being manufactured by an apparatus for and a method of manufacturing a roll-formed component for aircraft use according to Embodiment 1 or 2 of the present disclosure.

Hereinafter, preferred embodiments of the present disclosure are described with reference to the drawings. In the drawings, the same or corresponding elements are denoted by the same reference signs, and repeating the same descriptions is avoided below.

(Embodiment 1)

[One Example of Roll-Formed Component for Aircraft Use]

First, one representative example of a roll-formed component for aircraft use manufactured in the present disclosure (hereinafter, simply referred to as a "roll-formed component" as necessary) is specifically described with reference to FIG. 1 and FIG. 2.

In Embodiment 1, among various structural members used in manufacturing of an aircraft fuselage, a frame used in a cross-sectional direction (lateral direction) as shown in FIG. 1 is taken as one example of a roll-formed component 30. The roll-formed component 30 (i.e., the frame) has a curved shape as a whole. The dimension of the roll-formed component 30 in its width direction (i.e., the height in the width direction) is gradually reduced at a longitudinally central portion of the roll-formed component 30 compared to both longitudinally end portions thereof. For the sake of convenience of the description, a central portion of the roll-formed component 30 (a portion surrounded by a one-dot chain line in FIG. 1), including a portion whose dimension in the width direction is reduced (i.e., a variable portion), is hereinafter referred to as a variable width portion 30*a*.

Figure 2:
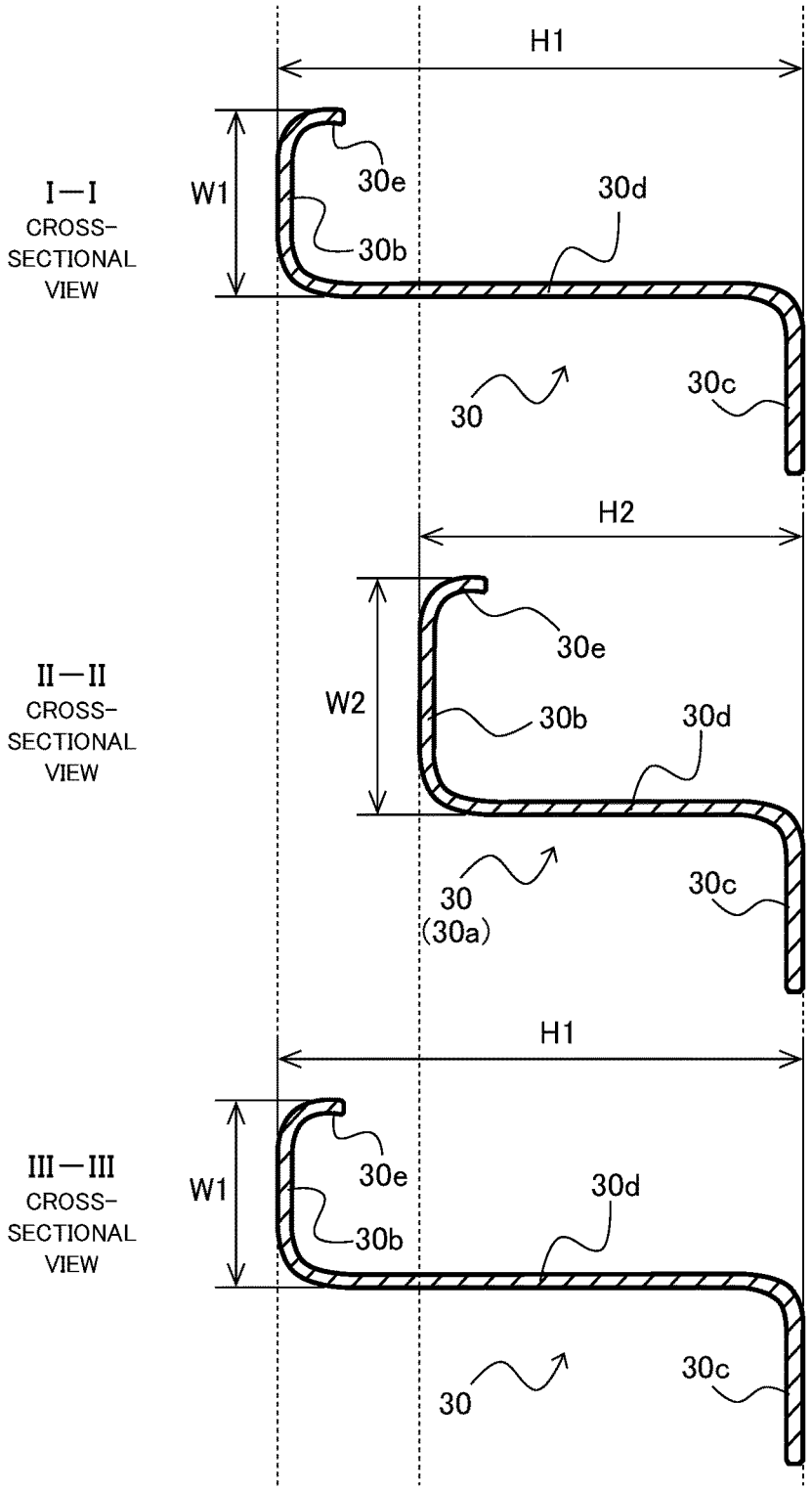
FIG. 2 is a schematic diagram for describing the variable width of the frame shown in FIG. 1 by comparing a cross-sectional shape of the frame taken along line I-I of FIG. 1 as viewed in the direction of the arrows of line I-I, a cross-sectional shape of the frame taken along line II-II of FIG. 1 as viewed in the direction of the arrows of line II-II, and a cross-sectional shape of the frame taken along line III-III of FIG. 1 as viewed in the direction of the arrows of line III-III.

As shown in FIG. 2, the cross section of the roll-formed component 30 of FIG. 1 is substantially Z-shaped (Z-shaped cross section). That is, both side edge portions 30*b* and 30*c* of the roll-formed component 30 in the width direction are bent in opposite directions to each other. It should be noted that, for the sake of convenience of the description, a part of the roll-formed component 30 excluding the side edge portions 30*b* and 30*c*, i.e., a central portion of the roll-formed component 30 in the width direction, is hereinafter referred to as a "width central portion 30*d*", and thereby distinguished from the longitudinally central portion of the roll-formed component 30 (i.e., distinguished from the variable width portion 30*a*).

In FIG. 2, a cross-sectional view taken along line I-I of FIG. 1 (two-dot chain line in FIG. 1) as viewed in the direction of the arrows of line I-I corresponds to the upper diagram in FIG. 2; a cross-sectional view taken along line II-II of FIG. 1 as viewed in the direction of the arrows of line II-II corresponds to the middle diagram in FIG. 2; and a cross-sectional view taken along line III-III of FIG. 1 as viewed in the direction of the arrows of line III-III corresponds to the lower diagram in FIG. 2. In the example shown in FIG. 2, one side edge portion 30*b* is bent upward in each diagram, and the other side edge portion 30*c* is bent downward in each diagram. The outermost part of the one side edge portion 30*b* is further bent toward the width central portion 30*d*. For the sake of convenience of the description, this outermost bent portion is referred to as a "folded-back portion 30*e*".

As shown in the upper diagram and lower diagram of FIG. 2, both the longitudinally end portions of the roll-formed component 30 do not vary in terms of the dimension in the width direction (i.e., the width of the width central portion 30*d* does not vary at both the longitudinally end portions of the roll-formed component 30). That is, the width central portions 30*d* of both the longitudinally end portions of the roll-formed component 30 have the same width H1. Also, the one side edge portions 30*b* of both the longitudinally end portions of the roll-formed component 30 have the same width W1. Meanwhile, the one side edge portion 30*b* of the variable width portion 30*a* (the longitudinally central portion) of the roll-formed component 30 has a width W2, which is greater than the width W1 of the side edge portions 30*b* of both the longitudinally end portions (W2>W1). The dimension of the variable width portion 30*a* in the width direction (i.e., the width of the width central portion 30*d*) is H2, which is less than the width H1 of the width central portions 30*d* of both the longitudinally end portions (H2<H1).

As described above, the roll-formed component 30 according to Embodiment 1 is formed such that: both the side edge portions 30*b* and 30*c* in the width direction of the roll-formed component 30 have a bent cross section; the dimension of the roll-formed component 30 in the width direction varies continuously in the longitudinal direction (i.e., a variable width is imparted to the roll-formed component 30); and a curved shape (contour) is imparted to the roll-formed component 30 in the longitudinal direction. It should be noted that although a variable width is imparted to the longitudinally central portion of the roll-formed component 30, the present disclosure is not thus limited. Alternatively, a variable width may be imparted to the longitudinally end portions. Moreover, although the roll-formed component 30 includes the variable width portion 30*a* only as its central portion, the roll-formed component 30 may alternatively include a plurality of variable width portions arranged in the longitudinal direction. Furthermore, the width W1 in the upper diagram of FIG. 2 need not be the same as the width W1 in the lower diagram of FIG. 2. Similarly, the width H1 in the upper diagram of FIG. 2 need not be the same as the width H1 in the lower diagram of FIG. 2.

Although in Embodiment 1 the frame is taken as an example of the roll-formed component 30, the present disclosure is not thus limited. The roll-formed component 30 according to the present disclosure may be any member for aircraft use, so long as it is obtained by performing roll bending of a roll formed member. For example, the roll-formed component 30 may be a known structural member, such as a stringer, stiffener, spar, floor beam, rib, frame, or a doubler. Moreover, the roll-formed component 30 manufactured in the present disclosure is not limited to a member for aircraft-use. The present disclosure is suitably applicable to a member having a bent structure for use in a different technical field, such as the field of automobiles or building materials.

It should be noted that, as shown in FIG. 2, the one side edge portion 30*b* of the roll-formed component 30 includes the folded-back portion 30*e*, and such a bent structure is referred to as a return flange. Meanwhile, the other side edge portion 30*c* of the roll-formed component 30 does not include the folded-back portion 30*e*, and such a bent structure is referred to as a single flange. In Embodiment 1, only the side edge portion 30*b* is a return flange. However, as an alternative, the side edge portion 30*c* may also be a return flange, or both the side edge portions 30*b* and 30*c* may be single flanges.

[Configuration Example of Apparatus for Manufacturing Roll-Formed Component]

Figure 3:
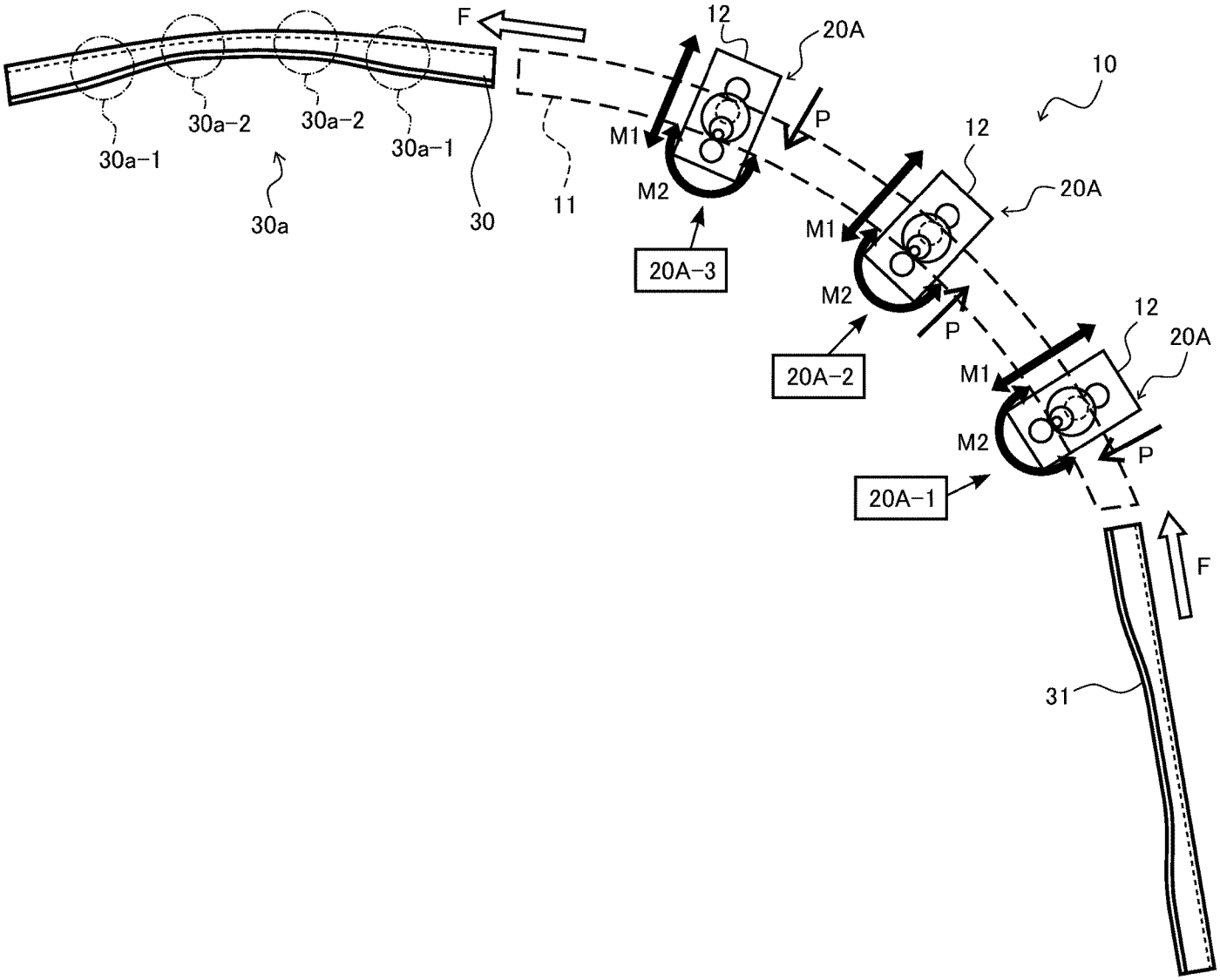
FIG. 3 is a schematic diagram showing one example of a schematic configuration of the apparatus for manufacturing a roll-formed component for aircraft use according to Embodiment 1 of the present disclosure.

Next, a specific description of one representative example of an apparatus for manufacturing the above-described roll-formed component 30 is given with reference to FIG. 3.

The specific configuration of the apparatus for manufacturing the roll-formed component 30 according to Embodiment 1 (the apparatus is hereinafter simply referred to as a "manufacturing apparatus" as necessary) is not particularly limited except the configuration of forming roll units (forming and/or bending roll units). As schematically shown in FIG. 3, a manufacturing apparatus 10 according to Embodiment 1 includes, for example: a curved bending path 11 (indicated by dashed line in FIG. 3), through which a roll formed member 31 is conveyed in its longitudinal direction; a plurality roll stands 12 arranged along the bending path 11; and forming roll units 20A mounted on the respective roll stands 12. It should be noted that each block arrow F shown in FIG. 3 indicates the conveyance direction of the roll formed member 31.

By machining the roll formed member 31 with the manufacturing apparatus 10, the roll formed member 31 is formed into the roll-formed component 30. The roll formed member 31 may be a known metal member. It should be noted that the dimensions of the roll formed member 31, such as the length, width, and thickness, are not particularly limited, and suitable dimensions can be set in accordance with the roll-formed component 30 to be manufactured. In the example shown in FIG. 3, the width of a portion of the roll formed member 31, the portion corresponding to the variable width portion 30*a*, is reduced in advance. However, the width of the roll formed member 31 is not thus limited.

The forming roll units 20A, each of which includes a plurality of roll members, are mounted on the respective roll stands 12 as mentioned above. The roll members of each forming roll unit 20A are rotatable, and as described below, include those configured to be movable in a rotational axis direction and a direction crossing the bending path 11. Further, as described below, the roll stands 12, on which the respective forming roll units 20A are mounted, each make sliding movement in the width direction of the conveyed roll formed member 31, and also, each make rotational movement about the normal direction to the roll formed member 31 as a rotational center. In FIG. 3, the sliding movement is indicated by block arrows M1, and the rotational movement is indicated by block arrows M2. It should be noted that, preferably, the rotational center is near the neutral axis in the bending of the roll formed member 31, or alternatively, near the plane of the one side edge portion 30*b* or the plane of the other side edge portion 30*c*. While imparting a variable width to the roll formed member 31, the facing direction of each roll stand 12 need not be exactly perpendicular to the bending path 11, but may be substantially perpendicular to the bending path 11, or may be roughly perpendicular to the bending path 11.

The number of roll stands 12 (forming roll units 20A) is not particularly limited, so long as a plurality of roll stands 12 (forming roll units 20A) are arranged along the bending path 11. It is preferable that at least three roll stands 12 (forming roll units 20A) be arranged as shown in FIG. 3. These roll stands 12 (forming roll units 20A) are each capable of applying an external force P (indicated by an arrow in FIG. 3) in the width direction of the roll formed member 31 as shown in FIG. 3.

An essential part of the manufacturing apparatus 10, i.e., a forming line, is for by arranging the plurality of roll stands 12 in a line. At the time of performing the forming, the roll formed member 31, which is an object (a member) subjected to the forming, is fed into the forming roll unit 20A of the first roll stand 12, and then conveyed to the forming roll units 20A of the following roll stands 12 sequentially. In this manner, the roll formed member 31 is conveyed in the conveyance direction F. Thus, the bending path 11 is a path (a route) though which the roll formed member 31, which is subjected to the forming by the plurality of roll stands 12 arranged in a line, passes.

In Embodiment 1, forming roll units 20A immediately adjoining each other are configured to apply the external forces P to the roll formed member 31 alternately. (The term "alternate" or "alternately" herein means that the direction in which the external force P is applied by one of the adjoining forming roll units 20A is opposite to the direction in which the external force P is applied by the other forming roll unit 20A.) This makes it possible to impart a favorable contour to the obtained roll-formed component 30.

As one example, among the forming roll units 20A in the manufacturing apparatus 10 shown in FIG. 3, the forming roll unit 20A positioned most upstream in the conveyance direction F on the bending path 11 is defined as a "most upstream position forming roll unit 20A-1". Similarly, the forming roll unit 20A positioned most downstream in the conveyance direction F on the bending path 11 is defined as a "most downstream position forming roll unit 20A-3". The forming roll unit 20A interposed between the most upstream position forming roll unit 20A-1 and the most downstream position forming roll unit 20A-3 is defined as a "middle position forming roll unit 20A-2". It should be noted that, for the sake of convenience of the description, each of the reference signs 20A-1 to 20A-3 in FIG. 3 is surrounded by a frame.

In the example shown in FIG. 3, the roll-formed component 30 is curved such that its central portion protrudes toward the upper side of FIG. 3, and similarly, the bending path 11 is also curved such that its central portion protrudes toward the upper right side of FIG. 3. For the sake of convenience of the description, a direction toward such a protruding central portion is defined as a "bending outward direction", and the direction opposite thereto is defined as a "bending outward direction". Accordingly, among the three forming roll units 20A included in the manufacturing apparatus 10, the most upstream position forming roll unit 20A-1 and the most downstream position forming roll unit 20A-3 both apply the external forces P in the bending inward direction. On the other hand, the middle position forming roll unit 20A-2 applies the external force P in the bending outward direction. Thus, in the manufacturing apparatus 10 shown in FIG. 3, forming roll units 20A immediately adjoining each other apply the external forces P in alternate directions.

It should be noted that the manufacturing apparatus 10 further includes known mechanisms or members, for example: supporting members that support the roll members included in the forming roll units 20A, such that the roll members are rotatable; roll drivers that cause the roll members to operate; a guide member for smoothly feeding the roll formed member 31 onto the bending path 11; and roll members for conveyance use. A specific description of these known mechanisms or members of the manufacturing apparatus 10 is omitted herein.

In the manufacturing apparatus 10 according to Embodiment 1, each forming roll unit 20A includes a plurality of roll members as described above. The plurality of roll members form an inter-roll area having a predetermined shape. Each forming roll unit 20A is configured to impart the external force P to the roll formed member 31 in the width direction while keeping the shape of each of the side edge portions 30*b* and 30*c* (or of the one side edge portion 30*b*), the shape being formed through bending. Accordingly, the arrangement of the roll members included in each forming roll unit 20A is automatically adjusted in accordance with the width of the roll formed member 31. This makes it possible to manufacture the roll-formed component 30, which has a predetermined cross-sectional shape and which includes the variable width portion 30*a*.

[Configuration Example of Forming Roll Unit]

Next, a representative configuration of each forming roll unit 20A included in the above-described manufacturing apparatus 10 is specifically described with reference to FIG. 4.

Figure 4:
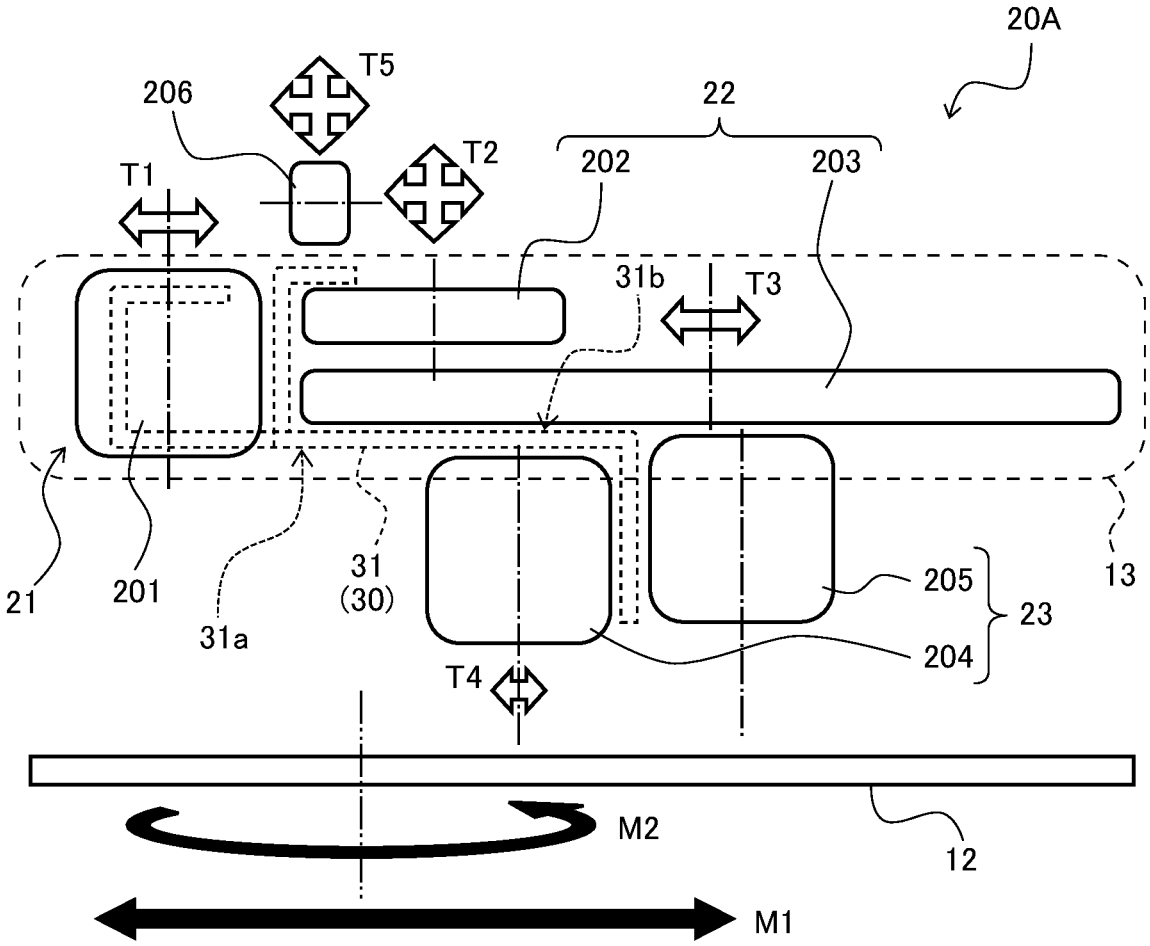
FIG. 4 is a schematic diagram showing the configuration of an essential part of a forming roll unit included in the apparatus for manufacturing a roll-formed component for aircraft use shown in FIG. 3.

As shown in FIG. 4, each forming roll unit 20A is formed by a total of six roll members (first to sixth rolls 201 to 206), and includes, for example: a receiving roll part 21 and a first bending roll part 22, which face each other; and a second bending roll part 23 positioned below these roll parts 21 and 22. Since each forming roll unit 20A is mounted on the corresponding roll stand 12 as described above. FIG. 4 schematically shows the roll stand 12 below the receiving roll part 21, the first bending roll part 22, and the second bending roll part 23.

It should be noted that, in FIG. 4, for the sake of convenience of the illustration of the first to sixth rolls 201 to 206, the roll formed member 31 (roll-formed component 30) is indicated by dashed line. An area corresponding to the roll formed member 31 indicated by dashed line is the aforementioned predetermined inter-roll area. Of both the surfaces of the roll formed member 31, the surface that comes into contact with the receiving roll part 21 is a front surface 31*a*, and the surface that comes into contact with the first bending roll part 22 is a back surface 31*b*. The front surface 31*a* of the width central portion 30*d* faces downward in FIG. 4, and the back surface 31*b* of the width central portion 30*d* faces upward in FIG. 4. Accordingly, the side the front surface 31*a* of the width central portion 30*d* faces is hereinafter referred to as the "lower side", and the side the back surface 31*b* of the width central portion 30*d* faces is hereinafter referred to as the "upper side".

The receiving roll part 21 is formed by the first roll 201. The first bending roll part 22 is formed by the second and third rolls 202 and 203, which are positioned parallel to each other such that the positions of their rotational axes are different from each other. As shown in FIG. 4, the roll face width of each of the second roll 202 and the third roll 203 is smaller than the roll face width of the first roll 201. The second roll 202 faces the upper portion of the roll face of the first roll 201, and the third roll 203 faces the lower portion of the roll face of the first roll 201.

The roll diameter of the third roll 203 is greater than that of the second roll 202. In other words, the first bending roll part 22 is formed by the second roll 202 with a smaller roll diameter and the third roll 203 with a greater roll diameter. The position of the rotational axis of the second roll 202 is different from the position of the rotational axis of the third roll 203. However, the position of the first roll 201 side of the roll face of the second roll 202 and the position of the first roll 201 side of the roll face of the third roll 203 are set to be substantially the same in the vertical direction. A plate member passing area is formed below the third roll 203, the plate member passing area allowing a part of the roll formed member 31 (the roll-formed component 30) excluding both the side edge portions 30*b* and 30*c*, i.e., the width central portion 30*d*, to pass through.

Bending of the one side edge portion 30*b* is performed by sandwiching the side edge portion 30*b* between the receiving roll part 21 (the first roll 201) and the first bending roll part 22 (the second roll 202 and the third rob 203). Here, the first bending rob part 22 is configured such that the distance between the second roll 202 and the third roll 203 forming the first bending roll part 22 is changed during the bending, which will be described below.

The second bending roll part 23 is positioned below the first bending rob part 22, and performs bending of the other side edge portion 30*c* of the roll formed member 31 (the roll-formed component 30). In Embodiment 1, as shown in FIG. 4, the second bending rob part 23 is formed by the fourth roll 204 and the fifth roll 205, which face each other. The fourth roll 204 has a rotational axis extending in the same direction as the rotational axes of the receiving roll part 21 and the first bending roll part 22, and comes into contact with the front surface 31*a* of the roll formed member 31. The space between the fourth roll 204 and the third roll 203 serves as the aforementioned plate member passing area.

As mentioned above, the fifth roll 205 is positioned facing the fourth roll 204. Accordingly, the fifth roll 205 comes into contact with the back surface 31*b* of the roll formed member 31, whereas the fourth roll 204 comes into contact with the front surface 31*a* of the roll formed member 31. Although the fifth roll 205 is positioned below the third roll 203, the space between the fifth roll 205 and the third roll 203 does not serve as the aforementioned plate member passing area.

In Embodiment 1, the forming roll unit 20A includes the sixth roll 206, which is positioned above the first bending roll part 22. The sixth roll 206 has a rotational axis crossing the rotational axes of the receiving roll part 21 and the first bending roll part 22, and bends the one side edge portion 30*b* toward the second roll 202. Thus, the sixth roll 206 serves as a roll for forming the folded-back portion 30*e* or a return flange, or serves as a roll for modifying the angle of a return flange formed in advance. Generally speaking, when the roll formed member 31 is subjected to bending in the longitudinal direction, there is a risk that, for example, the angle of a portion previously bent by 90° increases or decreases from 90° due to the bending. Therefore, the sixth roll 206 is provided in order to avoid or prevent such changes in the angle.

In FIG. 4, as indicated by one-dot chain lines, all the rotational axes of the first to fifth rolls 201 to 205 extend in the vertical direction, but only the rotational axis of the sixth roll 206 extends in a direction perpendicular to the vertical direction. When a direction that crosses the direction (the vertical direction) of the rotational axes of the first to fifth rolls 201 to 205 and that crosses the conveyance direction F (the direction perpendicular to the plane of FIG. 4) of the roll formed member 31 is defined as a "transverse direction", the rotational axis of the sixth roll 206 extends in the transverse direction. The transverse direction corresponds to the width direction of the roll formed member 31 conveyed in the inter-roll area (in particular, in the plate member passing area) of the forming roll unit 20A.

In the example shown in FIG. 4, the transverse direction is indicated as a direction perpendicular to both the vertical direction and the conveyance direction F. However, the transverse direction is not thus limited. The transverse direction may cross the vertical direction and the conveyance direction F non-perpendicularly. In addition, the direction of the rotational axis of the sixth roll 206 is not limited to the transverse direction, but may be inclined relative to the transverse direction, so long as the rotational axis of the sixth roll 206 crosses the rotational axes of the receiving roll part 21 and the first bending roll part 22 as mentioned above.

In FIG. 4, as indicated by block arrows T1 to T5, each of the first to fourth rolls 201 to 204 and the sixth roll 206 is movable at least in the transverse direction (i.e., the width direction of the roll formed member 31) relative the roll stand 12, on which the forming roll unit 20A is mounted. The fifth roll 205 is configured to be non-movable relative to the roll stand 12. Accordingly, in other words, each of the first to fourth rolls 201 to 204 and the sixth roll 206 is configured to be movable relative to the fifth roll 205.

Among the first to fourth rolls 201 to 204 and the sixth roll 206, the second roll 202 and the sixth roll 206 are movable also in the vertical direction as indicated by block arrows T2 and T5. Thus, the second roll 202 and the sixth roll 206 are biaxial roll members, whereas the first roll 201, the third roll 203, the fourth roll 204, and the fifth roll 205 are uniaxial roll members.

Since the second roll 202 is movable in the vertical direction, the distance between the second roll 202 and the third roll 203 is changeable during the bending. The first roll 201, the second roll 202, and the third roll 203 are each configured to be independently movable in the transverse direction (the width direction of the roll formed member 31) during the bending (see block arrows T1 to T3). As indicated by the block arrow T4, the fourth roll 204 is movable independently of the fifth roll 205 by a small distance in the transverse direction (the width direction of the roll formed member 31).

Moreover, the sixth roll 206 is configured such that, during the bending, the distance between the third roll 203 and the sixth roll 206 is changeable, and also, the sixth roll 206 is movable in the transverse direction (in the width direction of the roll formed member 31). That is, the sixth roll 206 is capable of adjusting the angle of the folded-back portion 30*e* by moving closer to or away from the third roll 203 in a state where the outermost part of the one side edge portion 30*b* is sandwiched between the sixth roll 206 and the second roll 202.

The first to sixth rolls 201 to 206 are provided such that these roll members are rotatable relative to the roll stand 12 (see FIG. 3). A method used for fixing these roll members is not particularly limited. Also, a mechanism for causing the first to sixth rolls 201 to 206 to operate is not particularly limited. Any moving mechanism known in the field of roll forming and/or roll bending may be adopted. In addition, a specific configuration of the first to sixth rolls 201 to 206 is not particularly limited. Any suitable configuration known in the field of roll forming and/or roll bending may be adopted.

When the receiving roll part 21 and the first bending roll part 22, which face each other, are defined as a roll pair 13, the roll pair 13 is, as shown in FIG. 3 and FIG. 4, capable of making sliding movement in a direction M1 in the width direction of the roll formed member 31 and making rotational movement in a direction M2 about the normal direction to the roll formed member 31 as a rotational center.

It should be noted that a specific configuration for realizing the sliding movement and the rotational movement of the roll pair 13 is not particularly limited. FIG. 4 schematically shows the roll stand 12, on which the forming roll unit 20A is mounted. The roll stand 12 may be configured to include a known moving mechanism that makes it possible to realize the sliding movement and the rotational movement. With such a configuration, not only the roll pair 13 but also the entire forming roll unit 20A can be allowed to make sliding movement and rotational movement.

[Method of Manufacturing Roll-Formed Component]

Next, one example of a method of imparting a contour and a variable width to the roll formed member 31 by the forming roll units 20A with the above-described configuration, i.e., one example of a method of manufacturing the roll-formed component 30, is specifically described with reference to FIG. 1 to FIG. 4, FIG. 5A, and FIG. 5B.

First, as indicated by the conveyance direction F in FIG. 3, the roll formed member 31 is conveyed toward the manufacturing apparatus 10, such that the distal end of the roll formed member 31 reaches the first roll stand 12. At the time, the roll formed member 31 has been pre-formed into a Z-shaped cross section. However, for the sake of convenience of the description, FIG. 3 schematically shows the roll formed member 31 in the shape of a flat plate. Then, the distal end of the roll formed member 31 is fed into the inter-roll area of the forming roll unit 20A (an area indicated by dashed line in FIG. 4). It should be noted that each of FIG. 4, FIG. 5A, and FIG. 5B shows a view, in which the forming roll unit 20A is viewed from the upstream side of the conveyance direction F.

Figure 5A:
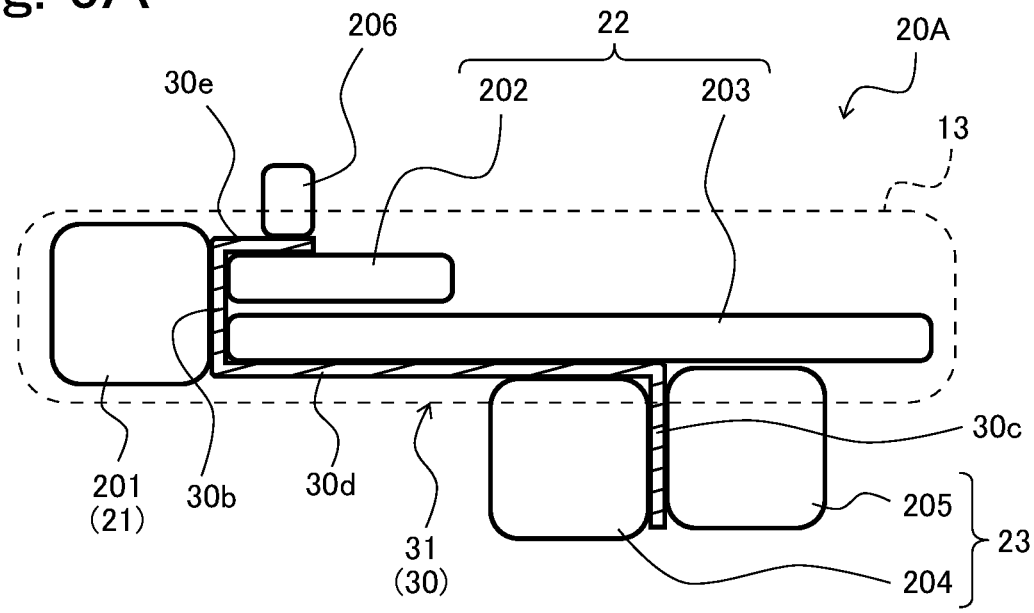
FIG. 5A and FIG. 5B are schematic diagrams showing examples of the operation of the forming roll unit shown in FIG. 4.
Figure 5B:
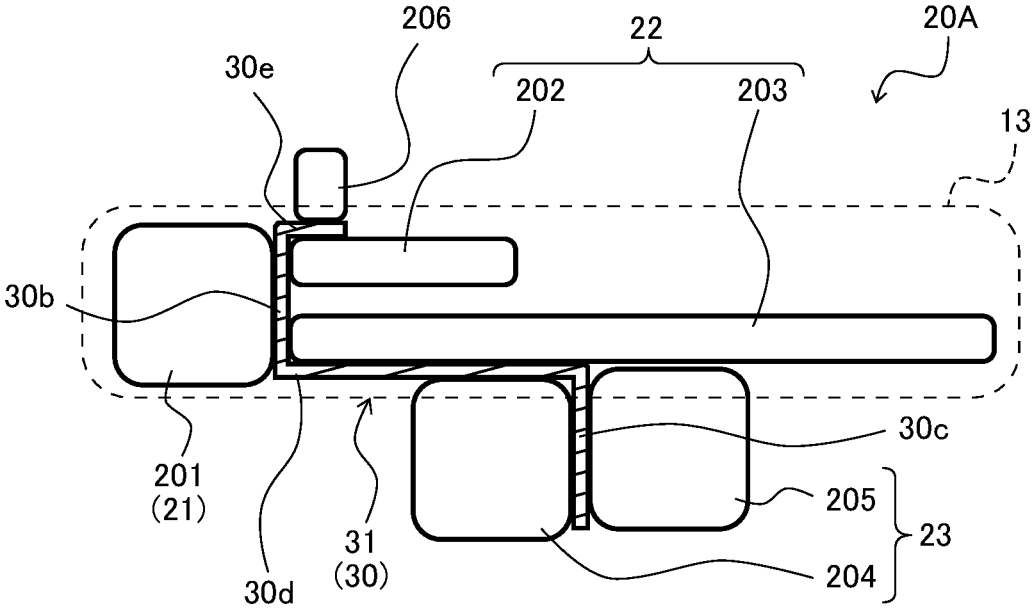

When the roll formed member 31 is conveyed into the inter-roll area, as shown in FIG. 5A, one bent side edge portion 30*b* of the roll formed member 31 is sandwiched between the receiving roll part 21 and the first bending roll part 22, and the other bent side edge portion 30*c* is sandwiched by the second bending roll part 23 (between the fourth roll 204 and the fifth roll 205). The roll formed member 31 excluding these side edge portions 30*b* and 30*c*, i.e., the width central portion 30*d*, passes through the plate member passing area between the fourth roll 204 and the third roll 203. It should be noted that the folded-back portion 30*e*, i.e., the outermost portion, of the side edge portion 30*b* is sandwiched between the sixth roll 206 and the second roll 202. In some cases, the folded-back portion 30*e* may be formed through bending by the sixth roll 206 and the second roll 202.

It should be noted that, as mentioned above, the roll formed member 31 has been pre-formed into a Z-shaped cross section. However, as an alternative, the roll formed member 31 may be a plate member that has not been fully pre-formed, i.e., a plate member having an incomplete Z-shaped cross section. In this case, in the forming roll unit 20A, if the side edge portion 30*b* is in a flat shape, it is bent between the receiving roll part 21 and the first bending roll part 22, and if the side edge portion 30*b* is in a flat shape, it is bent by the second bending roll part 23. Accordingly, by continuing the conveyance of the roll formed member 31, the bending of the side edge portion 30*b* and the bending of the side edge portion 30*c* in opposite directions to each other are performed in the longitudinal direction of the roll formed member 31, and thereby the manufacturing of the roll-formed component 30 (the frame for aircraft use) having a Z-shaped cross section is performed gradually. Thus, the Z-shaped cross section may be formed in advance, or may be formed by the forming roll unit 20A.

Here, during the bending of the roll formed member 31, when a to-be variable portion of the roll formed member 31, in which the width central portion 30*d* originally has a wide width, reaches the receiving roll part 21 and the first bending roll part 22, the receiving roll part 21 and the first bending roll part 22 gradually move toward the other side edge portion 30*c* (see FIG. 1 and FIG. 3). In this manner, the portion corresponding to the width central portion 30*d* shown in FIG. 5B can be formed as a variable portion. In addition, in a case where the width of the one side edge portion 30*b* is to be changed, the second roll 202 of the first bending roll part 22 and the sixth roll 206 gradually move away from or closer to the third roll 203. These rolls make sliding movement and rotational movement, which makes is possible to impart a predetermined contour to the roll formed member 31 even if the width of the roll formed member 31 varies.

It should be noted that the variable width portion 30*a* of the roll-formed component 30 shown in FIG. 1 can be roughly segmented into variable width portions 30*a*-1, 30*a*-2, 30*a*-3, and 30*a*-4, which are also shown in FIG. 3. The variable width portion 30*a*-1 is a portion where the dimension in the width direction gradually decreases from a large constant dimension (i.e., the width gradually decreases from a wide width). The variable width portion 30*a*-2 is a portion where the dimension in the width direction changes into a small constant dimension (i.e., the width becomes a narrow width). The variable width portion 30*a*-3 is a portion where the dimension in the width direction gradually increases from the small constant dimension (i.e., the width gradually increases from the narrow width). The variable width portion 30*a*-4 is a portion where the dimension in the width direction changes into a large constant dimension (i.e., the width becomes a wide width).

While the bending of the roll-formed component 30 is being performed from the variable width portion 30*a*-1 to the variable width portion 30*a*-2, the first roll 201, the second roll 202, and the third roll 203 keep making sliding movement in the respective transverse directions T1, T2, and T3 (along their horizontal axes; see FIG. 4) at least in accordance with the width of the variable width portion 30*a*-2. Similarly, also while the bending of the roll-formed component 30 is being performed from the variable width portion 30*a*-3 to the variable width portion 30*a*-4, the first roll 201, the second roll 202, and the third roll 203 keep making sliding movement in the respective transverse directions T1, T2, and T3.

In FIG. 4, FIG. 5A, and FIG. 5B, the position of the roll face of the second roll 202 and the position of the roll face of the third roll 203 are substantially the same. However, the positions of these roll faces are not thus limited. For example, the roll face of the second roll 202 may be protrudable further than the roll face of the third roll 203, or conversely, the roll face of the second roll 202 may be retreatable relative to the roll face of the third roll 203. This makes it possible to correct the angle of the corresponding portion.

As described above, in Embodiment 1, the plurality of forming roll units 20A are arranged along the curved bending path 11, and the rolls included in each forming roll unit 20A actively rotate, or rotate in accordance with the conveyance of the roll formed member. During the bending, the roll pair 13 including the receiving roll part 21 (the first roll 201) and the first bending roll part 22 (the second roll 202 and the third roll 203) is slidingly movable in the width direction of the roll formed member 31 (the transverse direction). When the roll formed member 31 to be conveyed is fed into the forming roll unit 20A, the one side edge portion 30*b* is interposed between the receiving roll part 21 and the first bending roll part 22, and a large part of the roll formed member 31 excluding the side edge portion 30*b* (i.e., the width central portion 30*d*) is supported at the lower side of the first bending roll part 22 (i.e., at the lower side of the third roll 203).

In this state, the roll pair 13 (the pair formed by the receiving roll part 21 and the first bending roll part 22) slidingly moves toward the other side edge portion 30*c*. As a result, the dimension of the roll formed member 31 in the width direction decreases gradually. On the other hand, in the case of gradually increasing the dimension of the roll formed member 31 in the width direction, the roll pair 13 may slidingly move away from the other side edge portion 30*c*. Although not illustrated, preferably, the roll pair 13 is further configured to be independently rotatable about the normal direction. This makes it possible to always position the roll pair 13 perpendicularly to the variable portion.

In this state, by causing the entire roll pair 13 to slide and make rotational movement about the normal direction as a rotational center in accordance with the spring-back amount of each roll included in the roll pair 13, a member having a variable cross section can be subjected to bending by roll bending. Consequently, a component for aircraft use to which a contour and a variable width have been imparted can be readily manufactured without performing, for example, stretch forming or press forming.

In addition, in Embodiment 1, the distance between the second roll 202 and the third roll 203 forming the first bending roll part 22 is changeable. Therefore, for example, by increasing or decreasing the distance between the second roll 202 and the third roll 203 in accordance with the width of the one side edge portion 30*b* while the roll pair 13 is making sliding movement or making both sliding movement and rotational movement, the bending can be performed in a manner to continuously change not only the dimension of the roll formed member 31 in the width direction but also the bending width of the one side edge portion 30*b*.

In the case of imparting both a contour and a variable width to the conveyed roll formed member 31, the roll pair 13 is set perpendicularly to, at least, a tangent line that extends relative to the bending direction of the roll formed member 31. Here, if the roll formed member 31 does not extend in the width direction (i.e., has no dimension in the width direction) and is a complete "line", a contour can be imparted to the roll formed member 31 by causing the roll pair 13 to make sliding movement. However, in reality, the roll formed member 31 extends in the width direction, and for this reason, a contour cannot be imparted to the roll formed member 31 solely by the sliding movement. Therefore, the roll pair 13 is caused to make both sliding movement and rotational movement. This makes it possible to manufacture the roll-formed component 30, to which both a contour and a variable width have been imparted.

Although the roll-formed component 30 manufactured in Embodiment 1 includes the variable width portion 30*a*, the manufacturing apparatus 10 for manufacturing a roll-formed component according to the present disclosure is also applicable to the manufacturing of a roll-formed component 30 that does not have the variable width portion 30*a* but that varies in terms of curvature. For example, the present disclosure is also applicable to the manufacturing of a roll-formed component 30 that is manufactured in such a manner that the bending of the roll formed member 31 is started with a curvature R=120, and in the middle of the bending, the curvature is changed to R=115.

[Variations]

In Embodiment 1, as shown in FIG. 4, FIG. 5A, and FIG. 5B, each forming roll unit 20A includes the first to sixth rolls 201 to 206, i.e., a total of six roll members. However, the present disclosure is not thus limited. Variations of the forming roll unit 20A are described with reference to FIG. 6 and FIGS. 7A and 7B.

Figure 6:
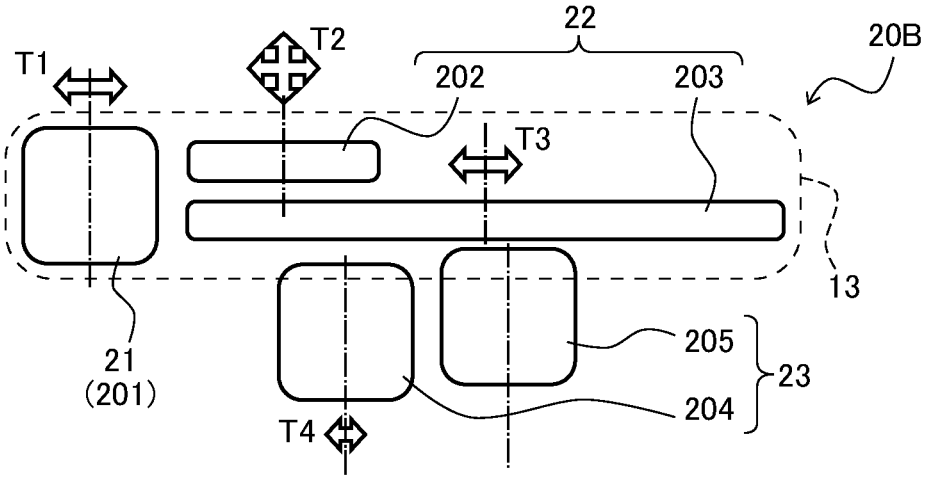
FIG. 6 is a schematic diagram showing a variation of the forming roll unit shown in FIG. 4.

For example, the present disclosure encompasses a forming roll unit 20B shown in FIG. 6, which does not include the sixth roll 206. As described above, the side edge portion 30*b* need not be a return flange, but may be a single flange. Accordingly, when the side edge portion 30*b* is to be formed into a single flange, the sixth roll 206 is not an essential component.

Figure 7A:
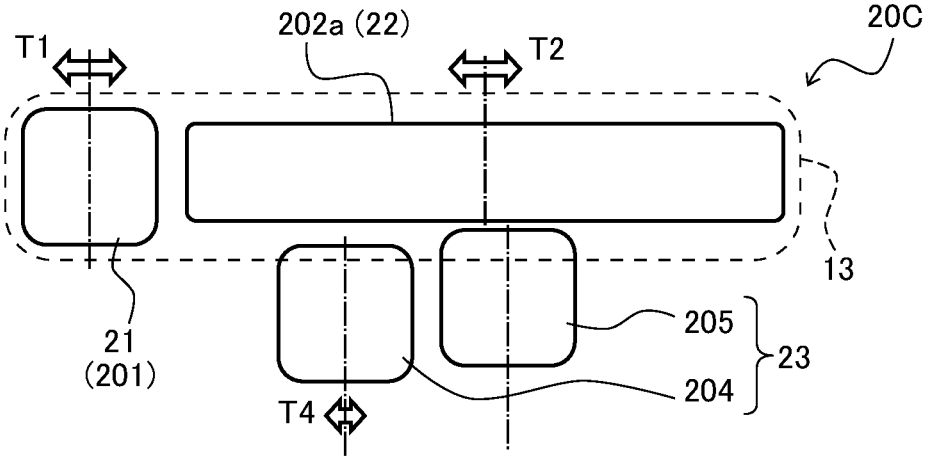
FIG. 7A and FIG. 7B are schematic diagrams showing other variations of the forming roll unit shown in FIG. 4.

The present disclosure also encompasses a forming roll unit 20C shown in FIG. 7A, in which the first bending roll part 22 is formed solely by a second roll 202*a*. For example, in a case where the width of the one side edge portion 30*b* is not to be varied, it is not necessary that the second roll 202 and the third roll 203 be provided as separate components of the first bending roll part 22. In this case, forming the first bending roll part 22 solely by the single second roll 202*a* will suffice. This makes it possible to simplify the configuration of the forming roll unit 20C. It should be noted that since, for example, the rotation of the roll pair 13 and the rotation of the entire forming roll unit 20C are the same as the above-described rotation of the roll pair 13 and rotation of the entire forming roll unit 20A, the description thereof is omitted herein.

Figure 7B:
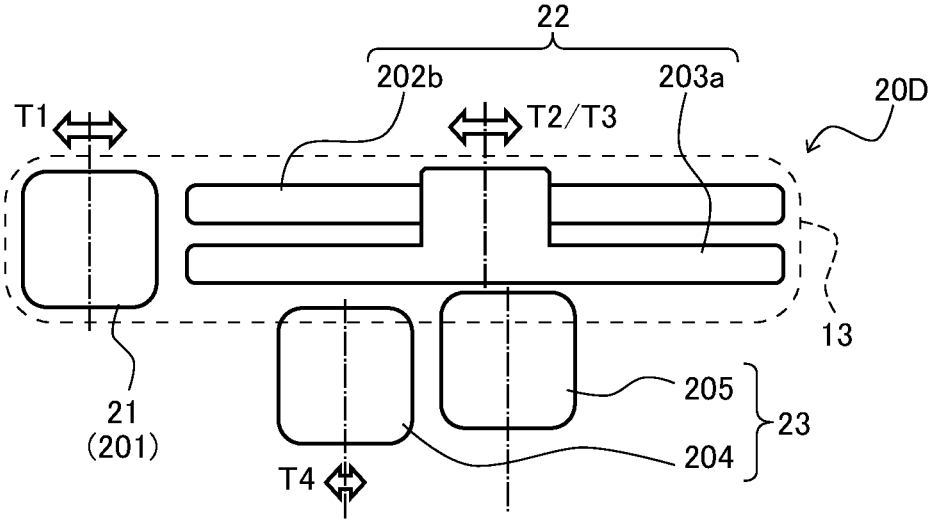

The present disclosure also encompasses a forming roll unit 20D shown in FIG. 7B, in which the first bending roll part 22 is formed by a second roll 202*b* and a third roll 203*a*, which have the same roll diameter. The second roll 202*b* and the third roll 203*a* share the same rotational axis, and for example, the following configuration is adoptable. As shown in FIG. 7B, the central portion of the second roll 202*b* is made hollow, and the central portion of the third roll 203*a* is made protrude. The protrusion of the third roll 203 is fitted in the hollow portion.

It should be noted that, similar to the forming roll unit 20B, each of the forming roll units 20C and 20D does not include the sixth roll 206. However, of course, each of the forming roll units 20C and 20D may include the sixth roll 206. Although not illustrated, the receiving roll part 21 of each of the forming roll units 20A to 20D is not limited to the configuration that is formed solely by the single first roll 201. Alternatively, the receiving roll part 21 of each of the forming roll units 20A to 20D may be formed by a plurality of roll members.

In Embodiment 1, the roll pair 13 is formed by the receiving roll part 21 and the first bending roll part 22 facing the receiving roll part 21. However, the configuration of the roll pair 13 is not thus limited. The roll pair 13 may be formed by other rolls, or a plurality of roll pairs 13 may be provided. That is, it will suffice if each of the forming roll units 20A to 20D includes at least one roll pair. For example, each of the forming roll units 20A to 20D may include, as roll pairs, not only a first roll pair 13, which comes into contact with and machines the one side edge portion of the roll formed member 31, but also a second roll pair, which is positioned below or above the first roll pair 13 and which comes into contact with and machines the other side edge portion of the roll formed member 31. In any of the configurations shown in FIG. 4 to FIGS. 7A and 7B, the second roll pair (the second bending roll part 23) may be formed by the fifth roll 205 and the sixth roll 206.

Alternatively, although not illustrated, each of the forming roll units 20A to 20D may additionally include a roll member other than the first to sixth rolls 201 to 206. For example, in the case of forming both the side edge portions 30*b* and 30*c* into return flanges, a roll member for use in forming the folded-back portion 30*e*, the roll member being similar to the sixth roll 206, may be provided below the second bending roll part 23. In Embodiment 1, the receiving roll part 21 is formed solely by the first roll 201. However, as an alternative, the receiving roll part 21 may be formed by a plurality of roll members. Similarly, the first bending roll part 22 may additionally include a roll member other than the second roll 202 and the third roll 203, and also, the second bending roll part 23 may additionally include a roll member other than the fourth roll 204 and the fifth roll 205.

Although not illustrated, the rotational axis direction of at least any one of the first to sixth rolls 201 to 206 and the other roll members included in the forming roll units 20A to 20D is not limited to the vertical direction as shown in FIG. 4 to FIGS. 7A and 7B, but may be inclined. Specifically, the configurations of the first to sixth rolls 201 to 206 (and the other roll members) are not limited to the configurations as shown in FIG. 4 to FIGS. 7A and 7B, in which the roll members are columnar (cylindrical) and sandwich the roll formed member 31 (the roll-formed component 30) with their peripheral surfaces. Alternatively, at least any one of the first to sixth rolls 201 to 206 and the other roll members included in the forming roll units 20A to 20D may be configured as a roll member whose overall cross section has a trapezoidal shape or whose partial cross section includes a trapezoid, such that the roll member includes an inclined peripheral surface.

As described above, in Embodiment 1, each of the forming roll units includes at least one roll pair, the roll pair including the receiving roll part and the bending roll part facing the receiving roll part, the receiving roll part coming into contact with at least one of the side edge portions. A plate member passing area is formed below or above the bending roll part, the plate member passing area allowing the roll formed member excluding the side edge portions to pass through. The at least one roll pair is configured to make, during the bending, sliding movement in the width direction of the roll formed member and rotational movement about the normal direction to the roll formed member as a rotational center.

Generally speaking, since such a material as metal has a spring-back property, when bending a roll formed member made of such a material, it is necessary to bend the roll formed member by an amount greater than a desired bending amount. For example, it is known that, in the case of aircraft use, a structural member having a wide width has a small spring back, but a structural member having a narrow width has a large spring back. Accordingly, in order to impart the same contour to different roll formed members, a person skilled in the art would easily notice the necessity of changing the roll pair position for each of a wide-width member and a narrow-width member.

Therefore, in order to manufacture both a wide-width member and a narrow-width member with the same manufacturing apparatus, it is necessary to cause the roll pair to make sliding movement. However, if the roll pair merely makes sliding movement, the roll pair does not become perpendicular to the roll formed member. As a result, excessive bending or shear is imparted to the roll formed member. Consequently, a favorable contour cannot be imparted to the roll formed member, and in addition, an excessive external force is applied to the roll pair.

In this respect, according to the above-described configuration, the roll pair can slidingly move, and also rotate to become perpendicular to the roll formed member. In addition, in the case of manufacturing a roll-formed component having a variable dimension in its width direction, the roll pair can be caused to make sliding movement such that the amount of the sliding is changed in accordance with the width of the roll formed member passing through the roll pair, and also, the roll pair can be caused to make smooth rotational movement while keeping the normal direction to the roll formed member as much as possible.

(Embodiment 2)

In Embodiment 1 described above, the manufacturing apparatus 10 shown in FIG. 3 is taken as a configuration example of the apparatus for manufacturing a roll-formed component. However, the present disclosure is not limited to this configuration example, but a different configuration is adoptable. Hereinafter, another configuration example of the method of manufacturing a roll-formed component is specifically described with reference to FIG. 8.

Figure 8:
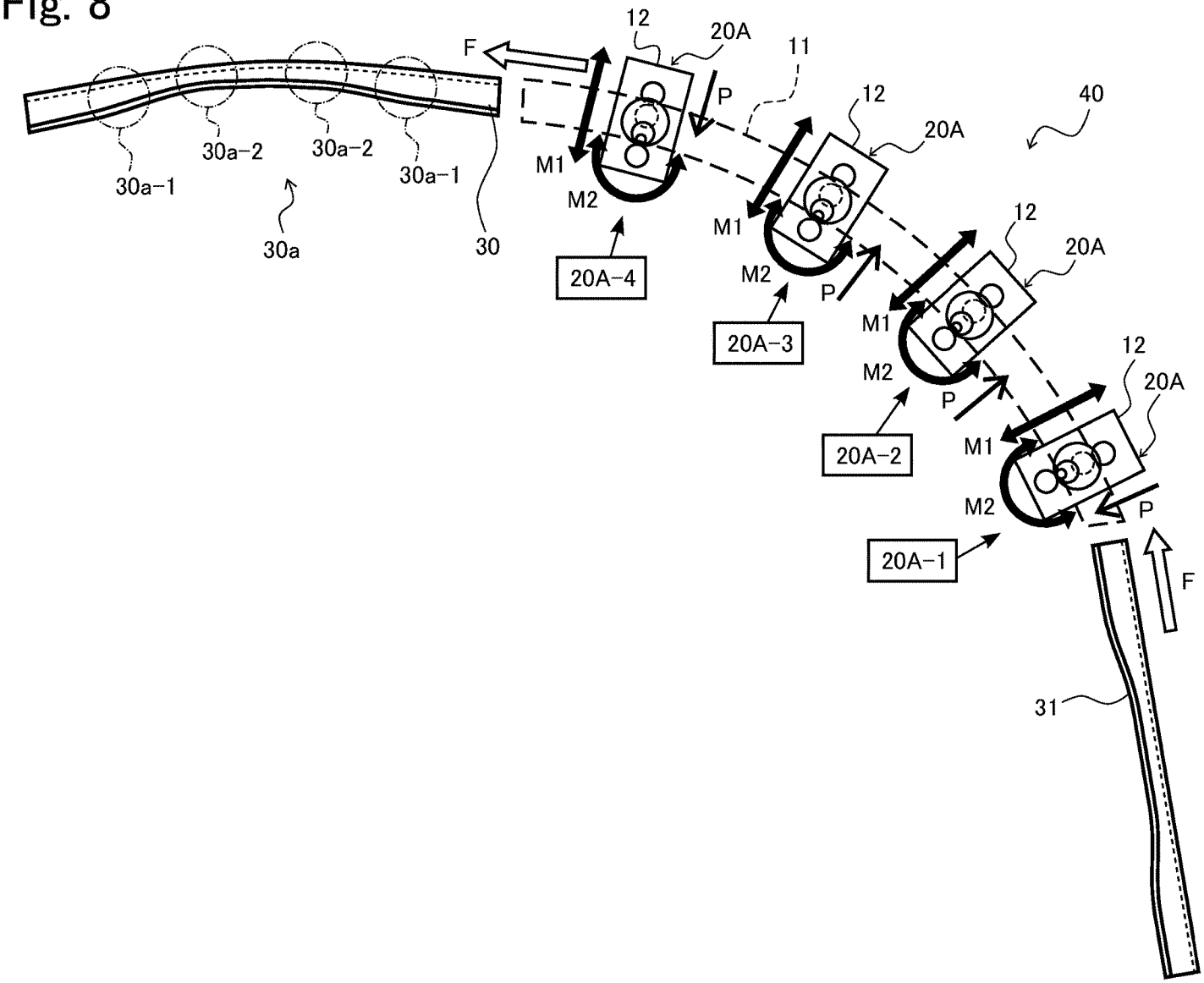
FIG. 8 is a schematic diagram showing one example of a schematic configuration of an apparatus for manufacturing a roll-formed component for aircraft use according to Embodiment 2 of the present disclosure.

As shown in FIG. 8, similar to the manufacturing apparatus 10 described above in Embodiment 1, a manufacturing apparatus 40 for manufacturing the roll-formed component 30 according to Embodiment 2 includes, for example: the curved bending path 11 (indicated by dashed line in FIG. 8), through which the roll formed member 31 is conveyed in its longitudinal direction; the plurality of roll stands 12 arranged along the bending path 11; and the forming roll units 20A mounted on the respective roll stands 12. In FIG. 8, similar to FIG. 3, the sliding movement of the roll pair 13 of each of the forming roll units 20A is indicated by a block arrow M1, and the rotational movement of the roll pair 13 is indicated by a block arrow M2.

It should be noted that since the specific configurations of the roll stands 12 and the forming roll units 20A included in the manufacturing apparatus 40 are the same as those described above in Embodiment 1, the description thereof is omitted herein. As described above, each forming roll unit 20A includes, for example: the supporting members that support the roll members included in the forming roll unit 20A, such that the roll members are rotatable; the roll drivers that cause the roll members to operate; the guide member for smoothly feeding the roll formed member 31 onto the bending path 11; and the roll members for conveyance use. Since these are known mechanisms or members, a specific description thereof is omitted herein as with Embodiment 1.

As one example, the above-described manufacturing apparatus 10 according to Embodiment 1 includes three forming roll units 20A. On the other hand, the manufacturing apparatus 40 according to Embodiment 2 includes four forming roll units 20A.

By arranging four roll stands 12 (i.e., the four forming roll units 20A) in a line in this manner, an essential part of the manufacturing apparatus 40, a forming line, is formed. The bending path 11 is a path (a route) though which the roll formed member 31, which is subjected to the forming by the plurality of roll stands 12 arranged in a line, passes. At the time of performing the forming, the roll formed member 31, which is an object (a member) subjected to the forming, is fed into the forming roll unit 20A of the first roll stand 12, and then conveyed to the forming roll units 20A of the following roll stands 12 sequentially. In this manner, the roll formed member 31 is conveyed in the conveyance direction F.

As shown in FIG. 8, these four roll stands 12 (forming roll units 20A) are capable of applying external forces P (indicated by arrows) in the width direction of the roll formed member 31. In the manufacturing apparatus 40 according to Embodiment 2, the directions of the external forces P applied to the roll formed member 31 in its width direction by the forming roll units 20A positioned at both ends of the bending path 11 are set to be the same. Meanwhile, the directions of the external forces P applied to the roll formed member 31 in its width direction by the forming roll units 20A interposed between the forming roll units 20A positioned at both ends of the bending path 11 are set to be opposite to the directions of the external forces P applied by the forming roll units 20A positioned at both ends of the bending path 11. This makes it possible to impart a favorable contour to the obtained roll-formed component 30.

As one example, among the forming roll units 20A in the manufacturing apparatus 40 shown in FIG. 8, the forming roll unit 20A positioned most upstream in the conveyance direction F on the bending path 11 is defined as a "most upstream position forming roll unit 20A-1". Similarly, the forming roll unit 20A positioned most downstream in the conveyance direction F on the bending path 11 is defined as a "most downstream position forming roll unit 20A-4". Of the two forming roll units 20A interposed between the most upstream position forming roll unit 20A-1 and the most downstream position forming roll unit 20A-4, the one positioned at the upstream side is defined as a "middle position forming roll unit 20A-2" and the one positioned at the downstream side is defined as a "middle position forming roll unit 20A-3". It should be noted that, for the sake of convenience of the description, similar to FIG. 3, each of the reference signs 20A-1 to 20A-4 in FIG. 8 is surrounded by a frame.

Also in the example shown in FIG. 8, for the sake of convenience of the description, the direction toward the aforementioned protruding central portion is defined as a "bending outward direction", and the direction opposite thereto is defined as a "bending inward direction". Accordingly, among the four forming roll units 20A included in the manufacturing apparatus 40, the most upstream position forming roll unit 20A-1 and the most downstream position forming roll unit 20A-4 both apply the external forces P in the bending inward direction. On the other hand, the middle position forming roll units 20A-2 and 20A-3 both apply the external forces P in the bending outward direction.

It should be noted that, looking at the positional relationship between the middle and both ends of the bending path 11 of the manufacturing apparatus 10 exemplified above in Embodiment 1, it is understood that, similar to the manufacturing apparatus 40 according to Embodiment 2, the directions of the external forces P applied by the forming roll units 20A positioned at both ends of the bending path 11 (the most upstream position forming roll unit 20A-1 and the most downstream position forming roll unit 20A-3) are set to be the same, and the direction of the external force P applied by the forming roll unit 20A positioned in the middle (the middle position forming roll unit 20A-2) is set to be opposite to the directions of the external forces P applied by the forming roll units 20A positioned at both ends of the bending path 11.

As described above, in the manufacturing apparatus according to the present disclosure, the number of the plurality of forming roll units arranged along the bending path is not particularly limited, but may be three as in Embodiment 1, or may be four as in Embodiment 2, or further alternatively, the number of forming roll units arranged along the bending path may be five or more or two although such examples are not shown. In addition, the directions of the external forces applied to the roll formed member in its width direction by the plurality of forming roll units are not particularly limited. For example, forming roll units immediately adjoining each other may apply the external forces in alternate directions. Alternatively, forming roll units immediately adjoining each other may apply the external forces in the same direction, and forming roll units positioned outside these adjoining forming roll units may apply the external forces in directions that are opposite to the directions of the external forces applied by these adjoining forming roll units.

As described above, the present invention is widely and suitably applicable in the field of manufacturing various roll-formed components, typically, for example, a frame that is a structural member for aircraft use.

It should be noted that the present invention is not limited to the embodiments described above, and various modifications cart be made within the scope of Claims. Embodiments obtained by suitably combining technical means that are disclosed in different embodiments and variations also fall within the technical scope of the present invention.

From the foregoing description, numerous modifications and other embodiments of the present invention are obvious to a person skilled in the art. Therefore, the foregoing description should be interpreted only as an example and is provided for the purpose of teaching the best mode for carrying out the present invention to a person skilled in the art. The structural and/or functional details may be substantially altered without departing from the spirit of the present invention.

What is claimed is:

1. An apparatus for manufacturing a roll-formed component, comprising:

a plurality of forming roll units arranged along a bending path, the bending path configured to be a path on which a roll formed member is subjected to bending in a longitudinal direction of the roll formed member, the forming roll units configured to perform the bending of the roll formed member while applying external forces to the roll formed member in a width direction of the roll formed member, wherein each of the forming roll units includes at least one roll pair, the roll pair including a receiving roll part and a bending roll part facing the receiving roll part, the receiving roll part configured to come into contact with at least one of side edge portions of the roll formed member, a plate member passing area is formed below or above the bending roll part, the plate member passing area configured to allow the roll formed member excluding the side edge portions to pass through, the at least one roll pair is configured to make, during the bending, sliding movement in the width direction of the roll formed member and rotational movement about a normal direction to the roll formed member as a rotational center, the at least one roll pair included in each of the forming roll units comprises a first roll pair and a second roll pair positioned below or above the first roll pair, the first roll pair is configured to come into contact with and to machine one side edge portion of the roll formed member, and the second roll pair is configured to come into contact with and to machine another side edge portion of the roll formed member.

2. The apparatus for manufacturing a roll-formed component according to claim 1, wherein the apparatus is configured to convey the roll formed member by sandwiching the at least one of the side edge portions between the receiving roll part and the bending roll part included in the roll pair.

3. The apparatus for manufacturing a roll-formed component according to claim 1, wherein the bending roll part is configured such that, during the bending, a distance between the bending roll part and the receiving roll part is changeable in accordance with a thickness of the passing roll formed member.

4. The apparatus for manufacturing a roll-formed component according to claim 1, wherein each of the forming roll units is configured such that the first roll pair makes sliding movement relative to the second roll pair in accordance with a change in the width of the passing roll formed member.

5. The apparatus for manufacturing a roll-formed component according to claim 1, wherein the receiving roll part includes a first roll, the bending roll part includes a second roll alone or a second roll and a third roll in combination, and the second roll and the third roll are positioned parallel to each other, and a distance between the second and third rolls is changed during the bending.

6. The apparatus for manufacturing a roll-formed component according to claim 5, wherein each of the forming roll units further includes a sixth roll positioned above or below the bending roll part, and the sixth roll has a rotational axis crossing rotational axes of the receiving roll part and the bending roll part, and bends one of the side edge portions toward the second roll.

7. The apparatus for manufacturing a roll-formed component according to claim 6, wherein the sixth roll is configured such that, during the bending, a distance between the third roll and the sixth roll is changeable and the sixth roll is movable in the width direction of the roll formed member.

8. The apparatus for manufacturing a roll-formed component according to claim 1, wherein the plurality of forming roll units arranged along the bending path are at least three forming roll units, and directions of the external forces applied to the roll formed member in the width direction by the forming roll units immediately adjoining each other are set to be opposite to each other.

9. The apparatus for manufacturing a roll-formed component according to claim 1, wherein the plurality of forming roll units arranged along the bending path are at least four forming roll units, directions of the external forces applied to the roll formed member in the width direction by the forming roll units positioned at both ends of the bending path are set to be the same, and directions of the external forces applied to the roll formed member in the width direction by the forming roll units interposed between the forming roll units positioned at both ends of the bending path are set to be opposite to the directions of the external forces applied by the forming roll units positioned at both ends of the bending path.

10. The apparatus for manufacturing a roll-formed component according to claim 1, wherein the roll-formed component is for aircraft use.

11. A method of manufacturing a roll-formed component, the method comprising:

manufacturing a roll-formed component by using the apparatus for manufacturing a roll-formed component according to claim 1, wherein the manufactured roll-formed component has:

a cross section in which a side edge portion of the roll-formed component in a width direction of the roll-formed component is bent;

a varying dimension in the width direction of the roll-formed component, the dimension varying continuously in a longitudinal direction of the roll-formed component; and a curved shape imparted in the longitudinal direction.

* * * * *